US007515030B2

(12) United States Patent
Schulte et al.

(10) Patent No.: US 7,515,030 B2
(45) Date of Patent: Apr. 7, 2009

(54) FUSE INSERT HAVING A FLAT INSULATING BODY

(75) Inventors: Henning Schulte, Wildeshausen (DE); Jürgen Scheele, Wildeshausen (DE)

(73) Assignee: Littelfuse Automotive GmbH, Dünsen (DE)

( * ) Notice: Subject to any disclaimer, the term of this patent is extended or adjusted under 35 U.S.C. 154(b) by 124 days.

(21) Appl. No.: 10/582,733

(22) PCT Filed: Dec. 13, 2004

(86) PCT No.: PCT/DE2004/002729

§ 371 (c)(1),
(2), (4) Date: Aug. 16, 2006

(87) PCT Pub. No.: WO2005/057602

PCT Pub. Date: Jun. 23, 2005

(65) Prior Publication Data

US 2007/0080772 A1 Apr. 12, 2007

(30) Foreign Application Priority Data

Dec. 13, 2003 (DE) ..... 203 19 350 U

(51) Int. Cl.
*H01H 85/08* (2006.01)
*H01H 85/175* (2006.01)

(52) U.S. Cl. ..... 337/159; 337/186; 337/198; 337/187

(58) Field of Classification Search ..... 337/159, 337/186, 198, 187
See application file for complete search history.

(56) References Cited

U.S. PATENT DOCUMENTS

| | | | | |
|---|---|---|---|---|
| 3,909,767 | A * | 9/1975 | Williamson et al. | 337/264 |
| 3,962,782 | A * | 6/1976 | Williamson et al. | 29/623 |
| 4,040,175 | A * | 8/1977 | Williamson et al. | 29/623 |
| 4,203,200 | A | 5/1980 | Wiebe | |
| 4,224,592 | A * | 9/1980 | Urani et al. | 337/198 |
| 4,349,804 | A * | 9/1982 | Gaia | 337/198 |
| 4,394,638 | A | 7/1983 | Sian et al. | |
| 4,499,447 | A * | 2/1985 | Greenberg | 337/266 |
| 4,580,124 | A * | 4/1986 | Borzoni | 337/264 |
| 4,604,602 | A * | 8/1986 | Borzoni | 337/264 |
| 4,635,023 | A * | 1/1987 | Oh | 337/163 |
| 4,670,729 | A * | 6/1987 | Oh | 337/262 |
| 5,239,282 | A * | 8/1993 | Filomia | 337/255 |

(Continued)

FOREIGN PATENT DOCUMENTS

EP 0 038 494 A 10/1981

(Continued)

OTHER PUBLICATIONS

International Search Report in English.

*Primary Examiner*—Anatoly Vortman
(74) *Attorney, Agent, or Firm*—Collard & Roe, P.C.

(57) ABSTRACT

The invention relates to a fusible element provided with a flat insulating body and a pair of contacts which are projected therefrom and whose sections receivable in the reception areas of the insulating body are connected to each other by a fusing conductor wherein at least one reception area and the contact section associated thereto comprise form-fitting connectors corresponding to each other. The inventive fusible element makes it possible to simplify assembling of the individual elements forming it without affecting the quality and without additional costs.

9 Claims, 3 Drawing Sheets

U.S. PATENT DOCUMENTS

| | | | | |
|---|---|---|---|---|
| 5,598,138 | A * | 1/1997 | Jaronczyk, Jr. | 337/265 |
| 5,629,664 | A * | 5/1997 | Muramatsu et al. | 337/261 |
| 5,818,320 | A * | 10/1998 | Matsuoka | 337/198 |
| 6,529,113 | B2 * | 3/2003 | Endo et al. | 337/198 |
| 6,556,120 | B2 * | 4/2003 | Endo et al. | 337/198 |
| 6,577,222 | B1 * | 6/2003 | Krueger et al. | 337/246 |
| 6,608,546 | B2 * | 8/2003 | Andoh et al. | 337/260 |
| 6,967,560 | B2 * | 11/2005 | Andoh et al. | 337/198 |
| 2004/0070485 | A1 * | 4/2004 | Andoh et al. | 337/198 |

FOREIGN PATENT DOCUMENTS

| | | |
|---|---|---|
| EP | 0 354 676 A | 2/1990 |

* cited by examiner

FUSE INSERT HAVING A FLAT INSULATING BODY

CROSS REFERENCE TO RELATED APPLICATIONS

Applicants claim priority under 35 U.S.C. §119 of German Application No. 203 19 350.4 filed Dec. 13, 2003. Applicants also claim priority under 35 U.S.C. §365 of PCT/DE2004/002729 filed Dec. 13, 2004. The international application under PCT article 21(2) was not published in English.

BACKGROUND OF THE INVENTION

The invention relates to a fuse insert having a flat insulating body and a pair of contacts projecting out of the insulating body, whose contact segments, which can be accommodated in accommodations of the insulating body, are connected with one another by way of a fusible conductor.

Fuse inserts having a flat insulating body are inserted into fuse holders with their contact tongues. Each fuse holder forms a disconnect in the line of a current circuit, and when the current circuit is intact, the fusible conductor bridges the disconnect. If a fault current occurs, the fusible conductor burns through, if applicable, and interrupts the current circuit.

In the case of known fuses, the insulating body that carries a fuse insert, in each instance, consists of plastics that are suitable for this purpose. The fuse inserts are generally punched parts made of metal, which are to be installed into the insulating body. The pre-finished insulating bodies and the fuse inserts, which are also pre-finished, if necessary, are brought together and connected with one another within a production line.

It is known to produce the connection by means of hot-embossing or ultrasound bonding, whereby locking of the fuse inserts usually takes place in that holes or break-throughs are disposed in their contact segments that are to be accommodated in the insulating body, which holes or break-throughs are penetrated by material of the insulating body, which has melted due to the heat applied during hot-embossing or ultrasound bonding. After the material, e.g. plastic, has cooled, each contact segment, and consequently each fuse insert, sits securely in the insulating body.

Aside from the effort and expenditure, in terms of process and devices, for carrying out hot-embossing processes or ultrasound bonding processes, with the cost disadvantages that result therefrom, forming the connection with heat also has the disadvantage that increased scrap rates can occur during the production of fuse inserts. This is connected with the fact that heating and cooling processes that proceed in absolutely uniform manner cannot be guaranteed, for example if only because of varying ambient temperatures at the production site.

SUMMARY OF THE INVENTION

The invention is based on the task of simplifying the manner in which the individual parts are combined to form a fuse insert, without having to accept losses in quality and, in particular, increases in cost in this connection.

This task is accomplished, according to the invention, by means of the characteristics of claim 1. Advantageous further developments and embodiments are evident from the dependent claims 2 to 10.

The connection elements of a positive-lock connection can easily be affixed to the components to be joined together, before they are joined together. During production of the fuse inserts, with their contacts, on a corresponding production line, as well as during production of the insulating bodies, for example using the injection-molding method, the corresponding connection elements can easily be formed, and they then enter into a positive lock when the individual parts of a fuse are combined. In this connection, no additional processes, such as hot embossing or ultrasound bonding, are then required. The fuse inserts are simply joined together with the insulating body, particularly plugged into one another.

This is particularly simple, since each accommodation is configured as a plug-in shaft, and each contact segment of the fuse insert is configured as a shaft part that can be inserted and fits into the plug-in shaft. A first connection element can project into the plug-in shaft, and the shaft part can have at least one engagement for this connection element. Of course, the reverse arrangement is also possible, namely that an engagement is formed on the plug-in shaft, for a connection element that projects from the shaft part.

However, placing engagements on the contact segments of the contacts of a fuse insert has the advantage that the expenditure of material and labor for the production of the fuse inserts is reduced to a minimum.

It is particularly advantageous if every engagement is a longitudinal groove formed in the respective contact segment. Each first connection element is then an elevation that projects into the plug-in shaft, in the form of a tongue that matches the longitudinal groove. The contact segments of the contacts of the fuse insert can thereby be pushed into the insulating body, in order to produce the fuse.

Groove and tongue have the advantage of improving the stability between the fuse insert, configured as a flat plug, and the insulating body. A reliable, wiggle-free seat is guaranteed. Depending on the fit between the components, the friction lock can also be increased, in order to arrive at a type of locking.

It furthermore promotes stability that the longitudinal groove extends over a predetermined part of the total length of the assigned shaft segments. Likewise, the tongue extends over a predetermined part of the total length of the plug-in shaft. In this way, mutual contact over as large an area as possible is made possible and, at the same time, critical material weakening is reduced.

Groove and tongue can also be configured in wedge shape, for example in order to obtain a friction lock, which becomes all the greater the more the final installation position of these parts, which are pushed into one another, is reached as the fuse insert and insulating body are joined together.

It is also possible to provide predetermined regions of the surfaces of plug-in shaft and shaft segment assigned to it, in each instance, which surfaces can be brought into contact with one another, with surface profiling that increases the friction. Such surface profiling can be, for example, small teeth configured as barbs, which block movement counter to the insertion direction, for example.

In order to lock insulating body and the fuse inserts configured as flat plugs in their final installation position, relative to one another, each free end of a contact segment of a contact tongue of a fuse insert can have a center notch. This center notch makes it possible to spread the notched head end of the contact segments, for example by setting on a corresponding pressure tool. In this way, the contact segments and thereby the fuse insert are locked together with the insulating body.

BRIEF DESCRIPTION OF THE DRAWINGS

An exemplary embodiment of the invention, from which other inventive characteristics are evident, is shown in the drawing. This shows.

DETAILED DESCRIPTION OF THE INVENTION.

Figure 1:
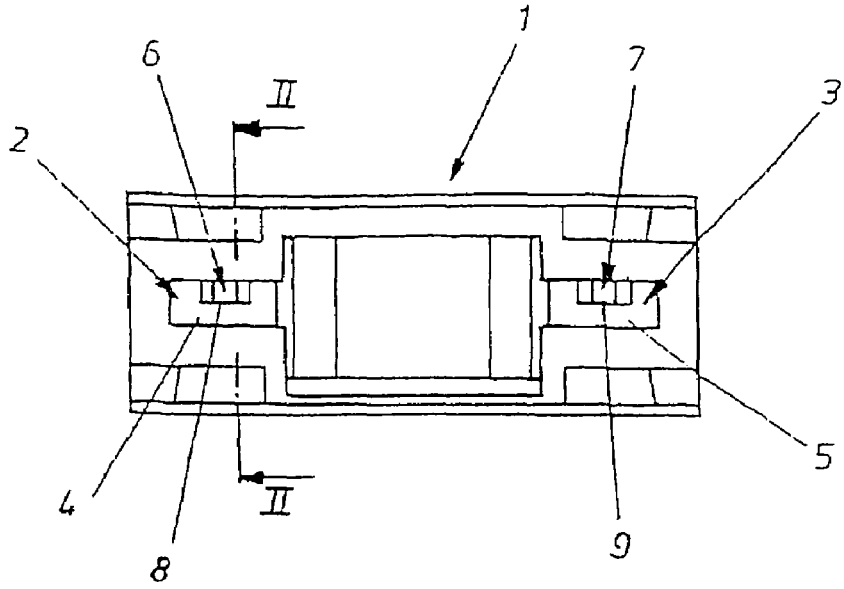
FIG. 1 an insulating body of a fuse from above.

FIG. 1 shows a top view of an insulating body 1 for a fuse. The insulating body 1 has accommodations 2 and 3, which are configured as plug-in shafts 4 and 5. A connection element 6 projects into the plug-in shaft 4. A connection element 7 also projects into the plug-in shaft 5. As shown here, the connection elements are configured as tongues 8, 9 that have been formed on.

The insulating body 1 is an injection-molded part made of plastic. Here, the insulating body is shown in approximately 10× magnification.

Figure 2:
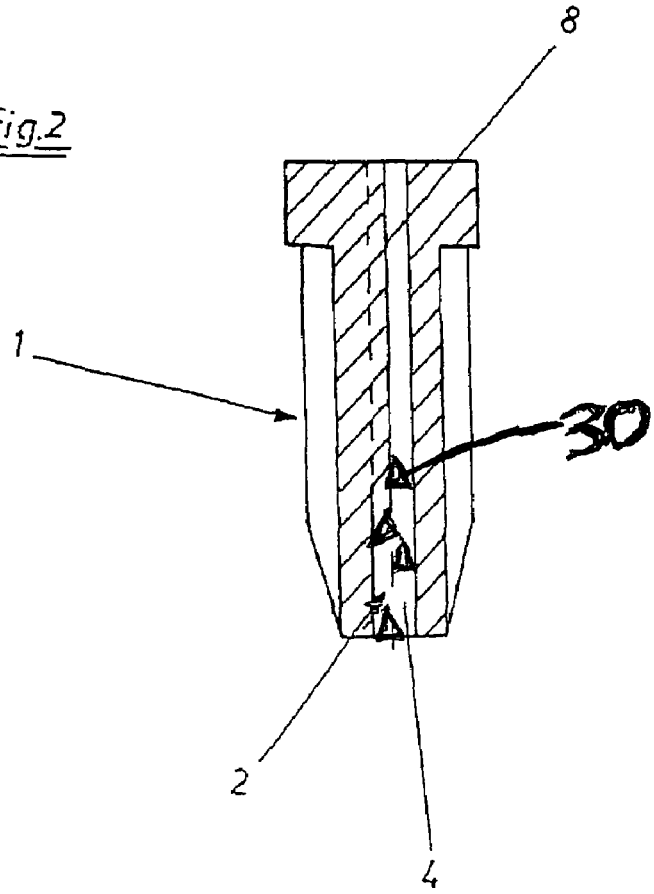
FIG. 2 a view of the insulating body in a section along the line II-II in FIG. 1, FIG. 3 a fuse insert configured as a flat plug, having contact segments connected by way of a fusible conductor, in a side view, FIG. 4 a view of a fuse insert configured as a flat plug, according to FIG. 3, in a section along the line IV-IV in FIG. 3, and FIG. 5 a side view of the complete fuse consisting of insulating body and fuse insert disposed in it.

FIG. 2 shows a view of the insulating body 1 in section along the line II-II in FIG. 1. The same components are designated with the same reference numbers.

FIG. 2 makes it clear how the tongue 8 projects into the plug-in shaft 4, and that the tongue 8 extends merely over part of the length of the plug-in shaft 4.

Figure 3:
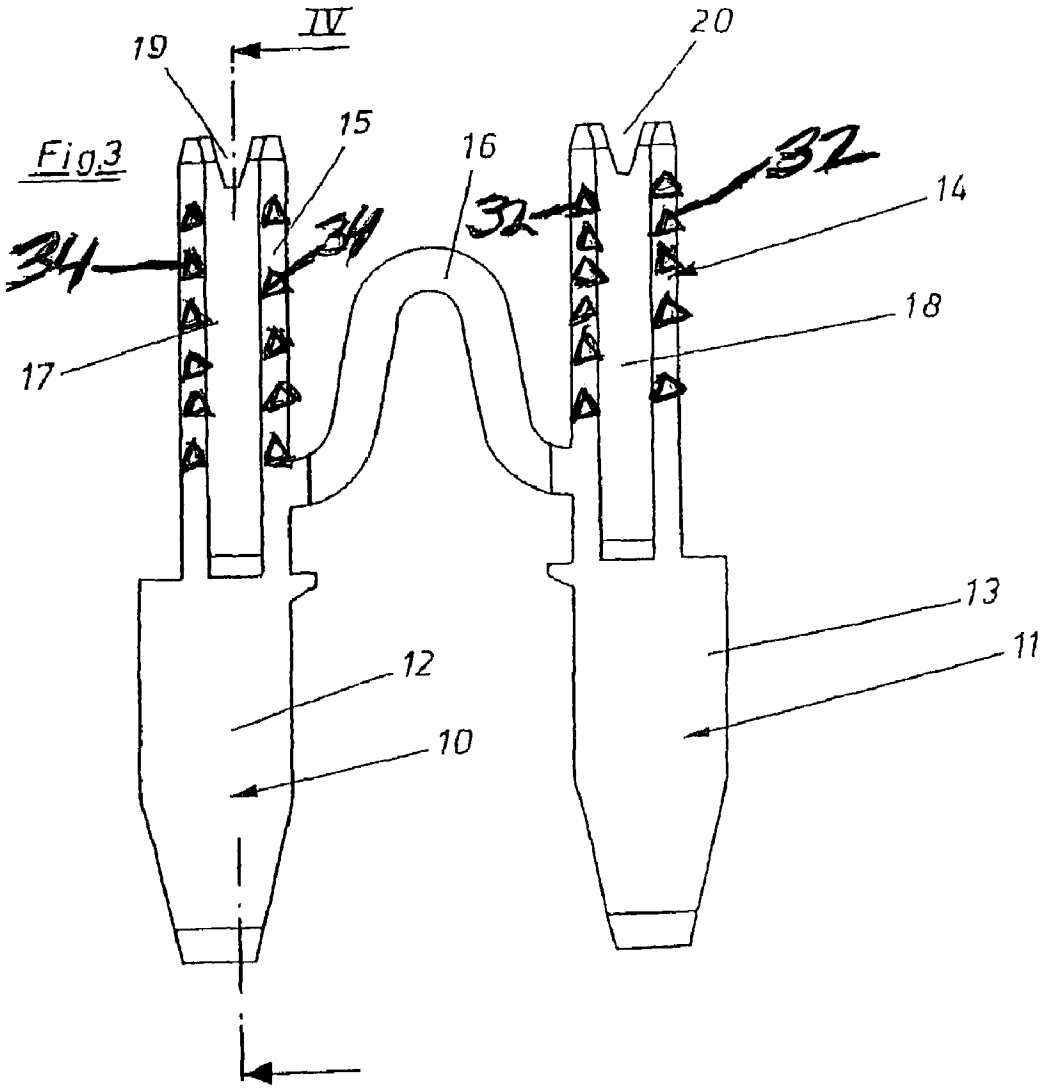

FIG. 3 shows the electrically conductive fuse insert made of metal, which is accommodated in the insulating body 1. The fuse insert, which is configured as a flat plug, consists of contacts 10 and 11, disposed next to one another to form a pair, having lower contact tongues 12 and 13, as well as contact segments 14 and 15 that are situated in the upper part. The contact segments 14 and 15 are connected with one another in electrically conductive manner by means of a fusible conductor 16.

Each contact segment 14, 15 is configured as a shaft part that fits into and can be plugged into the plug-in shaft 4, as shown here, which part has at least one engagement 17 or 18, respectively, for the projecting first connection element 6 or 7, respectively, of the insulating body 1. A center notch 19 or 20, respectively, is disposed at each free end of a contact segment 14 or 15, respectively, which faces away from the contact tongue 12 or 13, respectively. This center notch 19, 20 can be used for interlocking with the insulating body 1, by means of being bent apart or spread, using a suitable tool.

Figure 4:
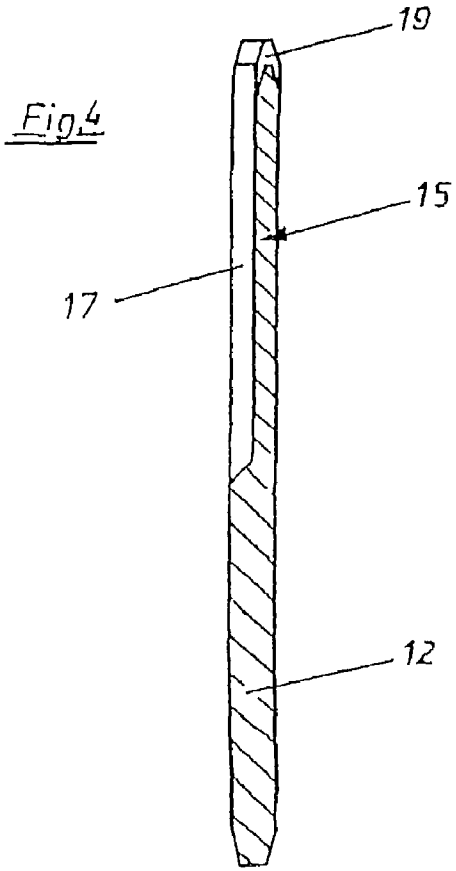

FIG. 4 shows a view of the fuse insert according to FIG. 3, configured as a flat plug, in a section along the line IV-IV in FIG. 3. The same components are designated with the same reference numbers.

FIG. 4 shows that the engagement 17, and therefore also the engagement 18 in the contact segment 15, or in the contact segment 14, respectively, is configured as a longitudinal groove, which extends over the major part of the total length of the assigned contact segment 14 or 15, respectively.

Figure 5:
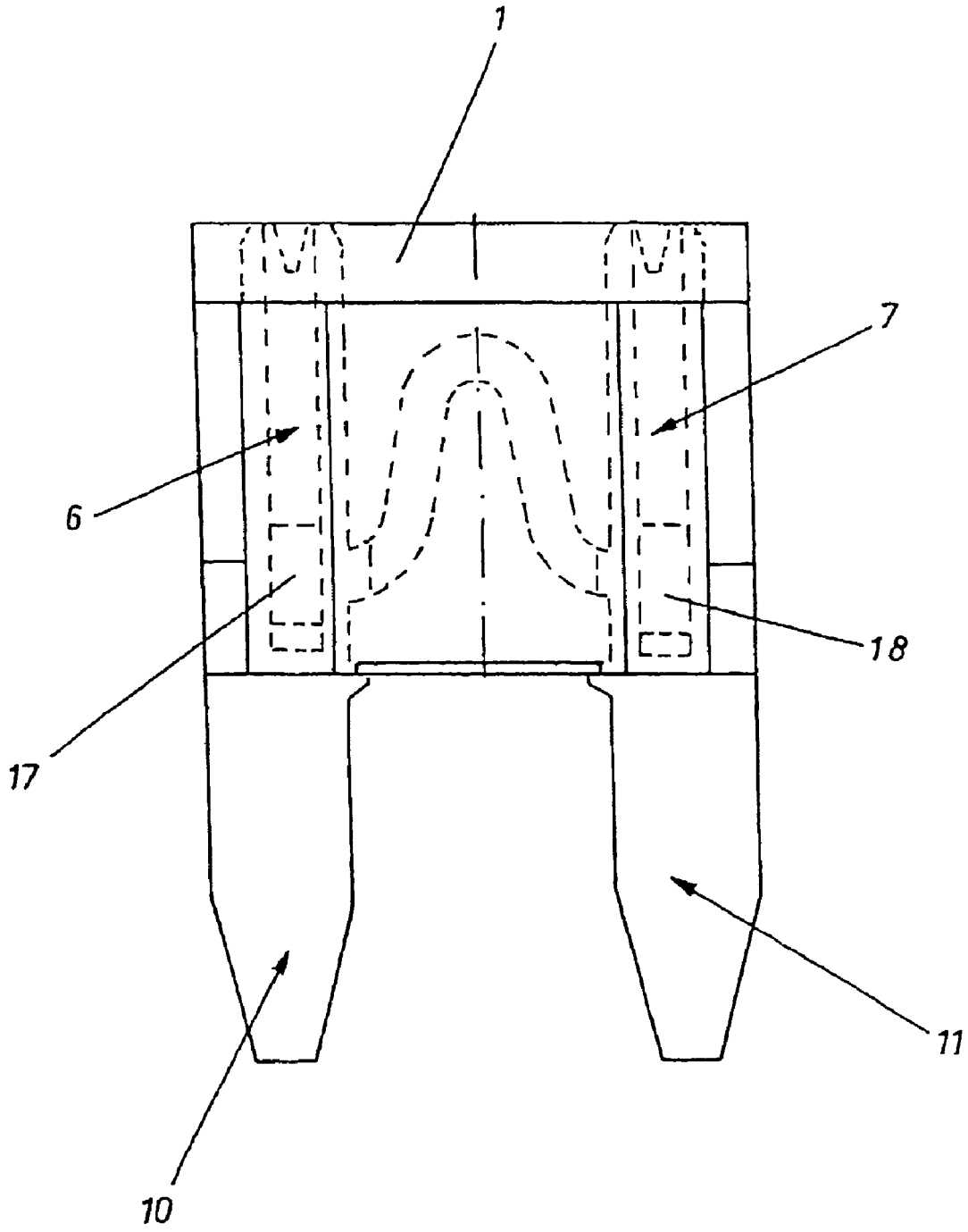

FIG. 5 shows a side view of a fuse having a flat insulating body 1 with fuse insert accommodated in it, the contacts 10, 11 of which project out of the insulating body 1, if the contact segments of the contacts 10, 11, which segments are configured as shaft parts, are inserted into the corresponding accommodations of the insulating body 1 from below, whereby the connection elements (engagement 17, 18, and projecting elevations 6, 7, respectively) that correspond to one another, indicated with broken lines here, enter into a positive-lock connection.

The fuse insert has predetermined regions of the surfaces of each plug-in shaft 4 and 5 and has associated contact segments 14 and 15, which surfaces can be brought into contact with one another, and have surface profiling that increases the friction. This surface profiling comprises small teeth configured as barbs 30, 32 and 34, which block movement counter to the insertion direction of the contacts into the insulating body 1. FIG. 2 shows the barbs 30 on shaft 4. FIG. 3 shows the barbs 32 on contact segment 14 and the barbs 34 on the contact segment 15.

The invention claimed is:

1. Fuse insert having a flat insulating body and a pair of contacts projecting out of the insulating body, whose contact segments, which are accommodated in accommodations of the insulating body, are connected with one another by way of a fusible conductor, wherein at least one of the accommodations (2, 3) as well as the contact segment (14, 15) assigned to it have connection elements (6, 7, 17, 18) of a positive-lock connection that correspond to one another; and wherein each first connection element (6, 7) is an elevation that projects into a plug-in shaft (4, 5), in the form of a tongue (8, 9) that matches a longitudinal groove as an engagement (17, 18).

2. Fuse insert according to claim 1, wherein each accommodation (2, 3) is configured as a plug-in shaft (4, 5), into which at least one first connection element (6, 7) projects.

3. Fuse insert according to claim 2, wherein each contact segment (14, 15) is configured as a shaft part inserted into the plug-in shaft (4, 5), said shaft part having at least one engagement (17, 18) for the at least one first connection element (6, 7).

4. Fuse insert according to claim 3, wherein each engagement (17, 18) is a longitudinal groove that has been formed in.

5. Fuse insert according to claim 4, wherein each longitudinal groove extends over a predetermined part of the total length of an associated contact segment.

6. Fuse insert according to claim 1, wherein the connection element that is present as a tongue (8, 9) extends over a predetermined part of the total length of the plug-in shaft (4, 5).

7. Fuse insert according to claim 1, wherein predetermined regions of the surfaces of each plug-in shaft (4, 5) and associated contact segment (14, 15), which surfaces are brought into contact with one another, have surface profiling that increases the friction.

8. Fuse insert according to claim 7, wherein the surface profiling comprises small teeth configured as barbs, which block movement counter to the insertion direction of the contacts into the insulating body (1).

9. Fuse insert according to claim 1, wherein each free end of a contact segment (14, 15) that faces away from a contact tongue (12, 13) has a center notch (19, 20).

* * * * *